US009808096B1

(12) United States Patent
Essenmacher et al.

(10) Patent No.: US 9,808,096 B1
(45) Date of Patent: Nov. 7, 2017

(54) WATER IMPERVIOUS CHAIR CUSHION

(71) Applicant: Arden Companies, Inc., Bingham Farms, MI (US)

(72) Inventors: Timothy James Essenmacher, Lathrup Village, MI (US); Kirsten Renee-Riess Barnds, Birmingham, MI (US); Can Kobaner, Cary, NC (US); Prasad Sudhir Bhatkhande, Bloomfield Hills, MI (US)

(73) Assignee: Arden Companies, Inc., Bingham Farms, MI (US)

( * ) Notice: Subject to any disclaimer, the term of this patent is extended or adjusted under 35 U.S.C. 154(b) by 569 days.

(21) Appl. No.: 14/452,333

(22) Filed: Aug. 5, 2014

Related U.S. Application Data

(60) Provisional application No. 61/863,197, filed on Aug. 7, 2013.

(51) Int. Cl.

| | |
|---|---|
| ***A47C 7/38*** | (2006.01) |
| ***A47C 27/00*** | (2006.01) |
| ***A47C 31/10*** | (2006.01) |
| ***A47C 31/11*** | (2006.01) |
| ***A47C 7/24*** | (2006.01) |

(52) U.S. Cl.
CPC ..... *A47C 31/113* (2013.01); *A47C 7/24* (2013.01); *A47C 7/383* (2013.01); *A47C 27/005* (2013.01); *A47C 31/105* (2013.01)

(58) Field of Classification Search
CPC ..... A47G 9/02; A47G 9/0238; A47G 9/0253; A47G 9/10; A47C 7/383; A47C 27/002; A47C 27/005; A47C 27/006; A47C 27/007; A47C 27/122; A47C 31/105
USPC ..... 5/652.1, 652, 484, 490, 699, 737, 738, 5/636, 645
See application file for complete search history.

(56) References Cited

U.S. PATENT DOCUMENTS 765,519 A * 7/1904 Sperry ..... A47G 9/10 428/6
819,903 A * 5/1906 Maussner ..... A47C 27/001 5/484
1,314,408 A * 8/1919 Lewis ..... B60R 13/04 112/417

(Continued)

OTHER PUBLICATIONS http://www.ballarddesigns.com/outdoor-living/outdoor-cushions/fast-dry-cushions/.

*Primary Examiner* — Robert G Santos
(74) *Attorney, Agent, or Firm* — Honigman Miller Schwartz and Cohn LLP

(57) ABSTRACT

A cushion includes a cushion shell formed to define a fill receiving cavity and a cushion fill that resides within the fill receiving cavity. The cushion shell includes a shell upper surface, at least one shell side surface and a bottom surface. The shell upper surface is generally oriented parallel to a first plane. The shell upper surface does not include any seams and is fabricated from at least one water impervious material. The at least one shell side surface is generally oriented parallel to a second plane perpendicular to the first plane. The shell side surface is fabricated from the at least one water impervious material. The shell bottom surface is generally oriented parallel to the first plane. The shell bottom surface is fabricated from a water pervious material and is joined to the side surface along a bottom edge seam.

19 Claims, 5 Drawing Sheets

(56) References Cited

U.S. PATENT DOCUMENTS 2,234,506 A * 3/1941 Sistig ..... A47G 9/10 15/244.4
2,620,494 A * 12/1952 Kay ..... A61F 5/485 297/DIG. 1
2,659,421 A * 11/1953 Wass et al. ..... A47C 27/003 112/417
2,898,975 A * 8/1959 Wagner ..... A47C 27/144 267/145
3,109,182 A * 11/1963 Doak ..... A47C 27/22 5/636
3,581,322 A * 6/1971 Marsico ..... A47C 27/05 5/699
3,818,520 A * 6/1974 Richards, Jr. ..... A47C 31/001 297/DIG. 5
4,080,675 A * 3/1978 Kanowsky ..... A47C 27/15 297/452.58
4,295,235 A * 10/1981 Deitz ..... A47C 31/113 156/308.4
4,508,044 A * 4/1985 Downey ..... A47G 9/10 112/420
4,776,048 A * 10/1988 Wilheim ..... B60N 2/4879 5/636
4,914,772 A 4/1990 Difloe
5,005,241 A 4/1991 Difloe
5,093,946 A 3/1992 Difloe
5,189,743 A 3/1993 Difloe
6,381,778 B1 * 5/2002 Peterson ..... A47C 27/005 5/484
6,631,529 B1 * 10/2003 Erickson ..... A47G 9/0246 5/484
6,918,146 B2 * 7/2005 England ..... A47C 7/021 297/284.1
6,988,286 B2 * 1/2006 Schecter ..... A47G 9/10 5/645
2004/0019972 A1 * 2/2004 Schecter ..... A47G 9/10 5/645
2004/0255385 A1 * 12/2004 England ..... A47C 7/021 5/655.9

* cited by examiner

WATER IMPERVIOUS CHAIR CUSHION

CROSS REFERENCE TO RELATED APPLICATIONS

This U.S. patent application claims priority under 35 U.S.C. §119(e) to U.S. Provisional Application 61/863,197, filed on Aug. 7, 2013. The disclosure of this prior application is considered part of the disclosure of this application and is hereby incorporated by reference in its entirety.

TECHNICAL FIELD

This disclosure relates to seat cushions. More specifically, this disclosure relates to seat cushions for outdoor use that are impervious to water.

BACKGROUND

Outdoor furniture generally has a relatively hard seating surface to provide durability for withstanding the elements of the outdoor environment. Cushions are often added to outdoor furniture for added comfort to the seating and/or back surfaces. The cushions typically provided for outdoor furniture are generally utilitarian in order to withstand a typical outdoor environment, e.g., rain, fog and moisture.

External surfaces of the cushions may be formed of plastic to provide a waterproof surface desired to prevent the interior cushion material from soaking water in the event of rain or other precipitation. However, such plastic materials are generally unappealing to a user's comfort and become damaged over time due to harsh ultraviolet radiation emitted by the sun. The external surfaces generally include one or more seams upon a top surface allowing a passage way for water to enter the interior cushion material. The external surfaces may also include welting around the top surface creating a stop or dam for water to reside on the top surface, and eventually enter the interior cushion material. Interior cushions are generally fabricated from materials such as foam, that are susceptible to absorbing water.

SUMMARY

One aspect of the disclosure provides a cushion that includes a cushion shell formed to define a fill receiving cavity and a cushion fill that resides within the fill receiving cavity. The cushion shell includes a shell upper surface, at least one shell side surface and a bottom surface. The shell upper surface is generally oriented parallel to a first plane. The shell upper surface does not include any seams and is fabricated from at least one water impervious material. The at least one shell side surface is generally oriented parallel to a second plane perpendicular to the first plane. The shell side surface is fabricated from the at least one water impervious material. The shell bottom surface is generally oriented parallel to the first plane. The shell bottom surface is fabricated from a water pervious material and is joined to the side surface along a bottom edge seam Implementations of the disclosure may include one or more of the following features. In some implementations, the at least one shell side surface includes one or more portions joined together along a non-exposed side seam that includes stitching that is not directly exposed to the surfaces of the shell that are exterior to the fill receiving cavity. In other implementations, the at least one side surface does contain any seams. In some examples, the bottom edge seam may include non-exposed stitching that is not directly exposed to the surfaces of the shell that are exterior to the fill receiving cavity.

The cushion fill may be fabricated from a non-water absorbing material that permits water to easily pass through the cushion fill. In some examples, the non-water absorbing material of the cushion fill may include polyester fiber. The non-water absorbing material of the cushion fill may additionally be manufactured by an Air Laid process.

In some implementations, the cushion shell further includes welting that is provided along the bottom edge seam. The welting may include a welting cover material that defines a space wherein a welting core material resides. The welting cover material may be fabricated from the at least one water impervious material. Additionally or alternatively, the welting cover material may be sewn to the bottom edge seam using non-exposed stitching that is not directly exposed to the surfaces of the shell that are exterior to the fill cavity.

Another aspect of the disclosure provides a cushion that includes a cushion fill enclosed by a cushion shell. The cushion shell includes a shell upper surface containing no seams and at least one shell side surface each fabricated from a water impervious material. The cushion fill is fabricated from a non-water absorbing material and has a shape that forms a natural convex curvature profile in the shell upper surface when the cushion shell encloses the cushion fill.

In some implementations, the cushion fill includes three fill portions layered to form a stack. The three portions may include a top portion when the cushion is in the normal use orientation, a bottom portion and a middle portion sandwiched between the top and bottom portions. The middle portion may include a smaller size than each of the top and bottom portions along at least one dimension. In some examples, the middle portion is arranged between the top and bottom portions such that at least two edges of the middle portion are less than corresponding edges of the top and bottom portions. The middle portion may optionally include a density that is greater than densities of the top and bottom portions. In other implementations, the cushion fill includes at least two fill portions layered to form a stack.

In some implementations, the natural convex curvature profile formed in the shell upper surface forms a natural roll around corners between the shell upper surface and the shell side surface.

In some implementations, the at least one side surface includes one or more portions joined together along a non-exposed side seam. The non-exposed side seam includes stitching that may not be visible to a viewer from outside of the cushion shell. In other implementations, the at least one side surface does not contain any seams.

The cushion shell may additionally include a shell bottom surface fabricated from a water pervious material and joined to the side surface along a non-exposed bottom edge seam. In some examples, welting may be provided that includes a welting cover material defining a space wherein a welting core material resides. The welting cover material may be fabricated from the water impervious material and sewn to the non-exposed bottom edge seam using non-exposed stitching.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
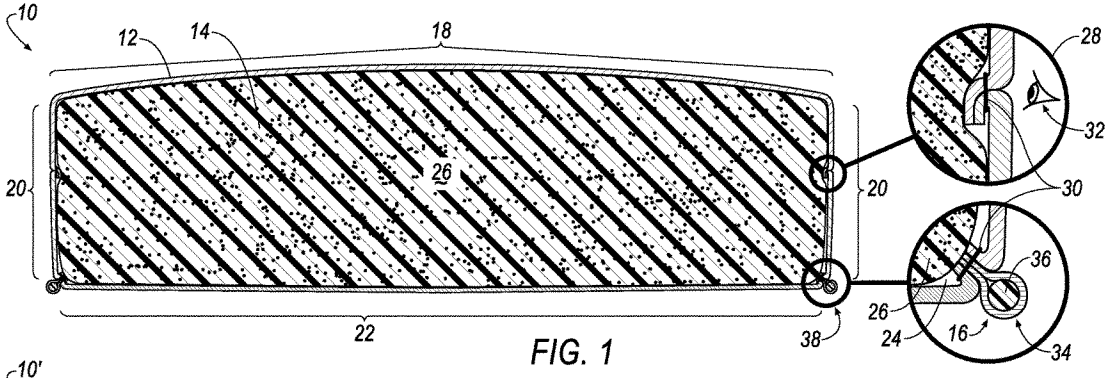
FIGS. 1-4 are cross-sectional views of a seat cushion including a cushion shell defining a fill receiving cavity wherein cushion fill resides.

Referring to FIGS. 1-4, in some implementations, a cushion 10 includes a cushion shell 12 and a cushion fill 14. In some implementations, the cushion is a removable cushion that may be placed upon seating (and/or back) surfaces of outdoor furniture. In other implementations, the cushion 10 may be integral to seating (and/or back) surfaces of outdoor furniture. The cushion shell 12 may include a shell upper surface 18, one or more shell side surfaces 20, and a shell bottom surface 22. The shell upper and bottom surfaces 18, 22, respectively, are generally oriented parallel to a first plane. The shell side surface 20 is generally oriented parallel to a second plane that is perpendicular to the first plane. In implementations when the cushion is utilized as a seating or bottom cushion segment 52 (FIG. 5), the first plane is generally oriented horizontally and the second plane is generally oriented vertically. In implementations when the cushion is utilized as a back cushion segment 50 (FIG. 5), the first plane is generally oriented vertically and the second plane is generally oriented horizontally.

The shell upper, side and bottom surfaces 18, 20, and 22, respectively, may be formed to define a fill receiving cavity 24 that corresponds to a space wherein cushion fill 26 resides. As used herein, the term "outside surfaces" refer to surfaces of the shell 12 that are exterior to the fill receiving cavity 24. When the cushion shell 10 is formed with fill 26 residing within the cavity, the shell upper surface 18 may include a natural convex curvature profile or crown that includes a natural roll or radius around the corners between the upper and side surfaces 18, 20, respectively, as described in greater detail below with reference to FIG. 9. The shell upper surface 18 having the natural convex curvature profile may prevent water or moisture from standing on the upper surface 18 by providing a slope for the water or moisture to roll or shed off. Implementations herein are directed toward the shell upper surface 18 having no seams (e.g., seamless) to prevent an ingress path for water or moisture to enter into the fill receiving cavity 24 from the generally horizontal shell upper surface 18. The shell upper and/or side surfaces 18, 20, respectively, may prevent water damming by not including any piping. Implementations herein are further directed toward the shell upper and side surfaces 18, 20, respectively, being fabricated from water impervious material to prevent water or moisture from entering the fill cavity 24 and soaking the fill 26 residing therein.

In some implementations, one or more portions of the shell side surface 20 may be joined to one or more portions of the shell bottom surface 22 along a non-exposed bottom edge seam 38. As used herein, the term "non-exposed seam" refers to stitching 30 that is not directly exposed to water or moisture that may be present on one or more outside surfaces of the shell 12. The non-exposed seam stitching on the bottom edge seam 38 may not be visible from the outside of the shell 12. The non-exposed bottom edge seam 38, and associated stitching 30, may be effective to prevent water or moisture from penetrating the outside surfaces and into the cavity 24.

Figure 2:
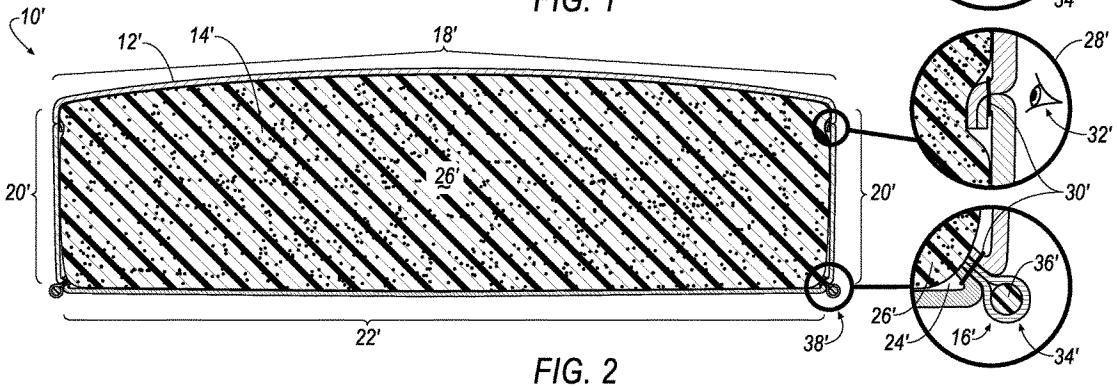
Figure 3:
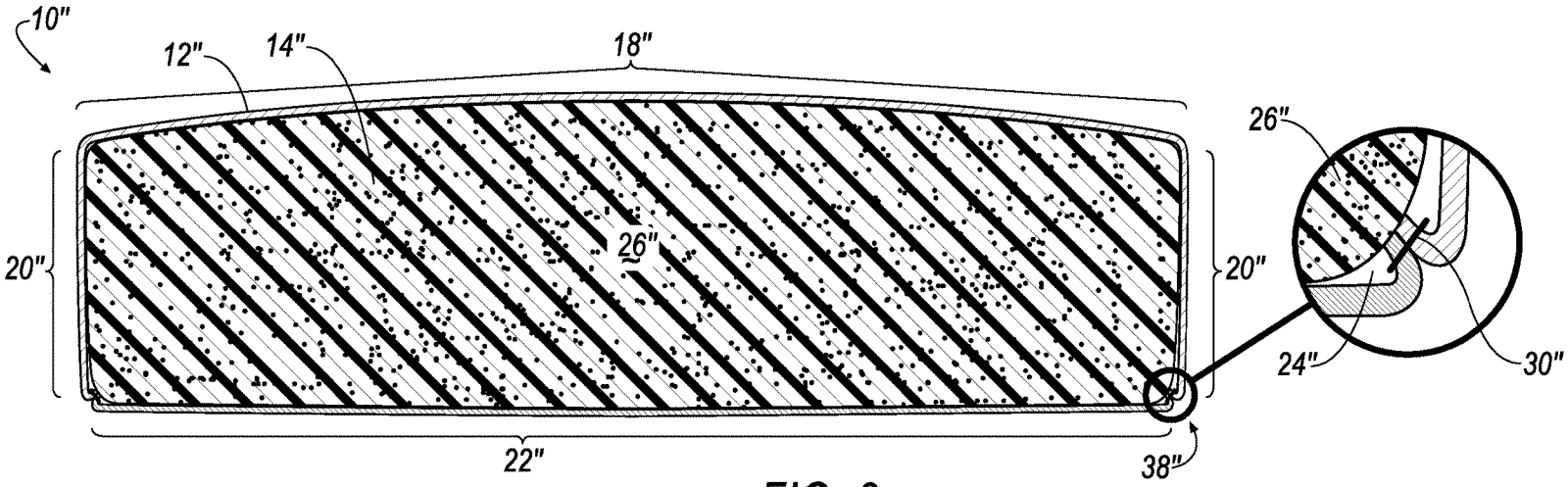
Figure 4:
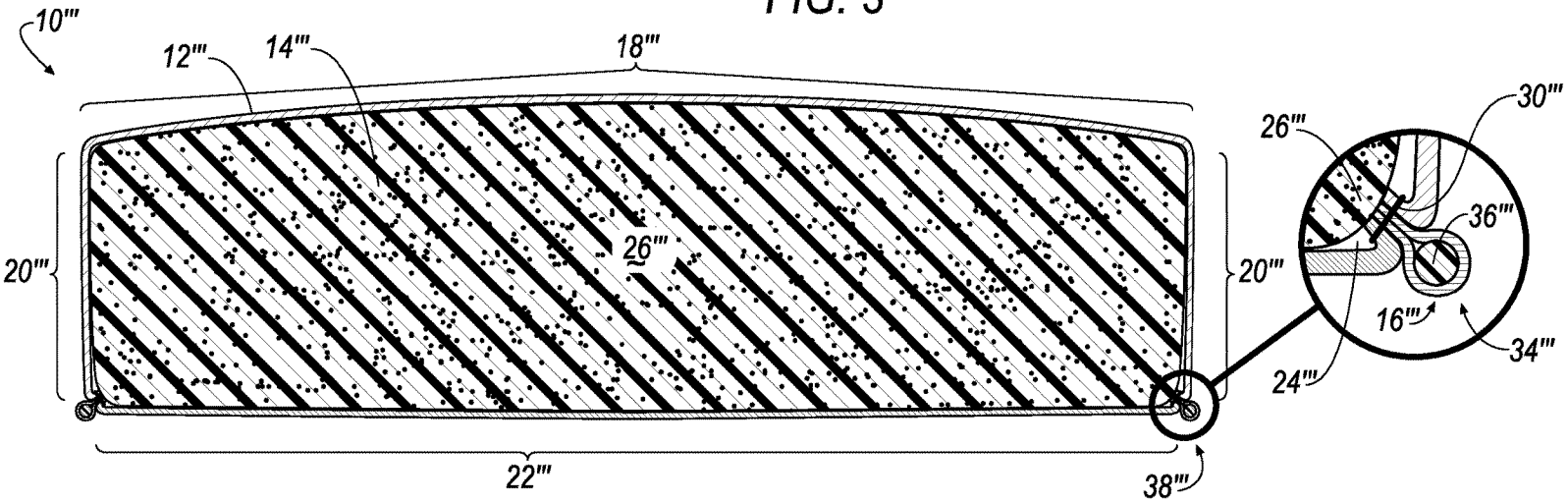

In some implementations, as illustrated in FIGS. 1, 2 and 4, welting 16 may be provided along the bottom edge seam 38. The welting 16 may include a welting cover material 34 defining a space where a welting core material 36 resides. The welting cover material 34 can be fabricated from any number of water impervious materials. In some examples, the welting 16 can be sewn to the bottom edge seam 38 by using non-exposed seam stitching to prevent the ingress of water that may be present on the outer surfaces of the shell 12 from penetrating into the shell receiving cavity 24.

In the examples illustrated in FIGS. 1 and 2, the shell side surface 20 may include one or more portions joined together along a non-exposed side seam 28, 28'. Here, the non-exposed side seams 28, 28' are effective to not directly expose the corresponding stitching 30, 30' to water or moisture that may be present on the side surface 20. The non-exposed side seam 28, 28' may not be visible to a viewer 32, 32' looking from the outside of the cavity 24, 24' toward the shell side surface 20, 20'. The non-exposed seam side 28, 28', and associated stitching 30, 30', may effectively prevent water or moisture from penetrating from the outside of the shell side surface 20, 20' and into the cavity 24, 24'. With respect to a midpoint between the top and bottom surfaces 18, 22, respectively, the non-exposed side seam 28 in FIG. 1 may be located proximately closer to the top surface 18 than the non-exposed side seam 28' shown in FIG. 2. Conventional cushion shells utilizing exposed seams, on the other hand, provide a direct pathway that is susceptible to allowing water or moisture to penetrate into the fill receiving cavity 24. In the examples illustrated in FIGS. 3 and 4, the shell side surface 20", 20'" has no seams (e.g., seamless) to prevent an ingress path for water or moisture to enter into the fill receiving cavity 24", 24'" from the outside of the shell side surface 20.

In some implementations, the cushion fill 26 is fabricated from a non-water absorbing material that permits water or moisture that may have penetrated into the fill residing cavity 24 to easily pass through the cushion fill 26. In some examples, the non-water absorbing material of the cushion fill 26 may include polyester fiber that does not absorb any water by way of its natural properties. Fabrication materials such as foam used by conventional fills, in contrast to polyester fiber, absorb water and moisture like a sponge. In some implementations, when polyester fiber is used as the cushion fill 26 material, the polyester fiber may be manufactured by an Air Laid process to advantageously permit the polyester fiber to stand in the vertical orientation to create a channel that allows water to flow through. Typical Cross Laid manufacturing processes, on the other hand, do not form such a channel for water to flow thru. Accordingly, polyester fill may be preferentially manufactured using the Air Laid process.

The shell bottom surface 22 may be fabricated from one or more materials that are pervious to water to allow any water residing within the fill residing shell cavity 24 to easily drain out (e.g., egress). For example, the bottom surface 22 may include mesh.

The implementations described with reference to FIGS. 1-4 include the shell 12 including upper and side surfaces 18, 20, respectively, that are fabricated from one or more materials that are impervious to water and the use of one or more non-exposed seams 28, 38' to prevent, or at least drastically reduce, water or moisture from penetrating into the fill residing cavity 24 and the fill 26 residing therein. In the event that any water or moisture does penetrate the shell 12 and enter the fill residing cavity 24, fabrication of the cushion fill 26 from non-water absorbing material and the fabrication of the cushion bottom surface 22 from water pervious material, advantageously permits the water or moisture to pass through the fill residing cavity 24 and exit the cushion shell 12 thru the bottom surface 22 when the cushion shell 12 is in the normal use orientation.

Figure 5:
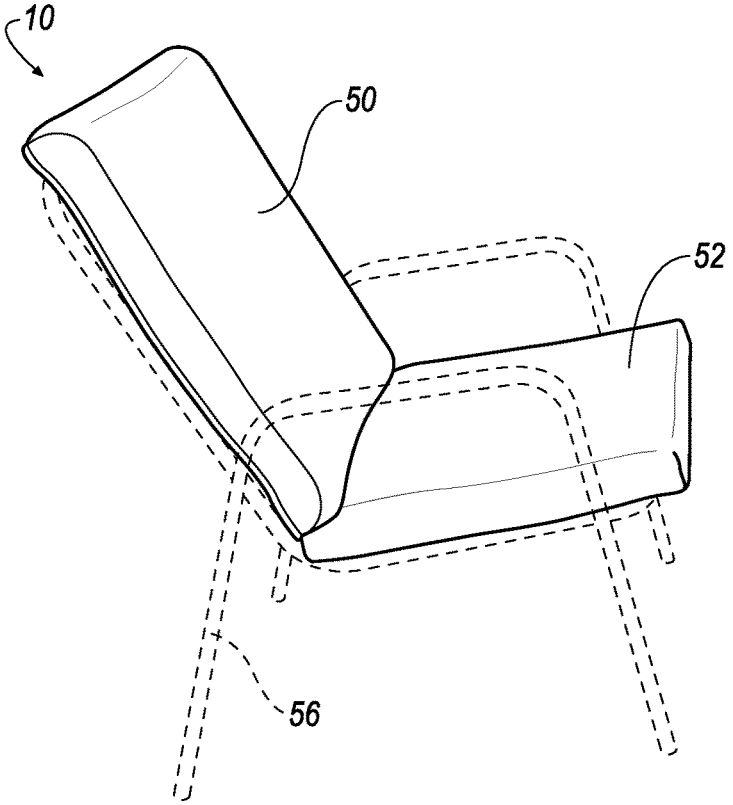
FIG. 5 is a perspective view of a chair frame including separated seat and back cushions.
Figure 6:
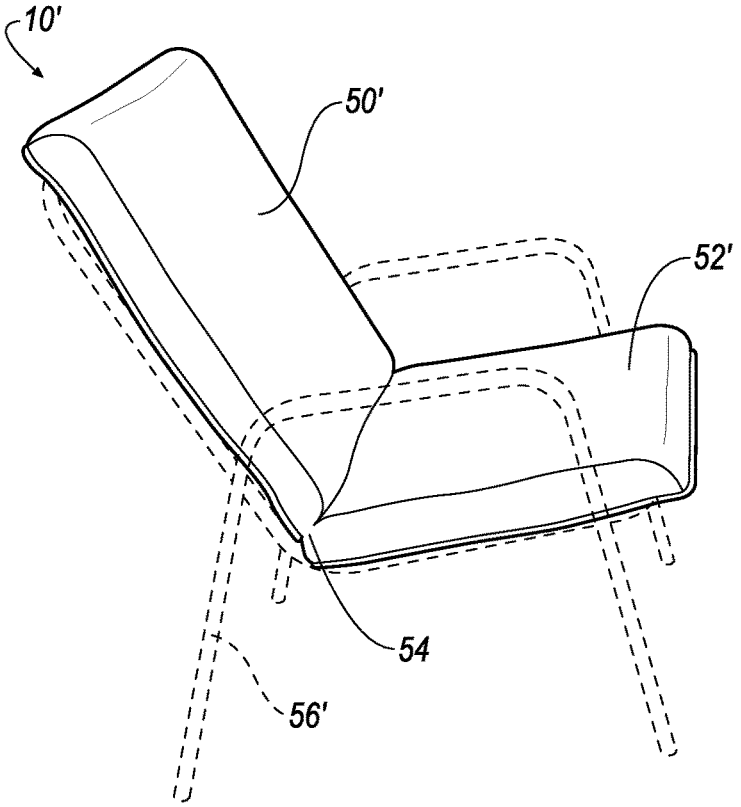
FIG. 6 is a perspective view of a chair frame including attached seat and back cushions.

In some implementations, referring to FIGS. 5 and 6, the cushion can be used to form a back cushion segment 50 or a bottom cushion segment 52 that are both used to cover portions of a chair frame. In the example provided in FIG. 5, the back and bottom cushions 50, 52, respectively, are not sewn or otherwise attached or joined to one another. In the example provided in FIG. 6, the back and bottom cushions 50', 52', respectively, may be joined together at one or more sections 54 and used to lay against the chair frame 50'. In some implementations, the back and bottom cushions 50', 52', respectively, may be joined to each other directly or indirectly, along one or more preexisting seams.

Figure 7A:
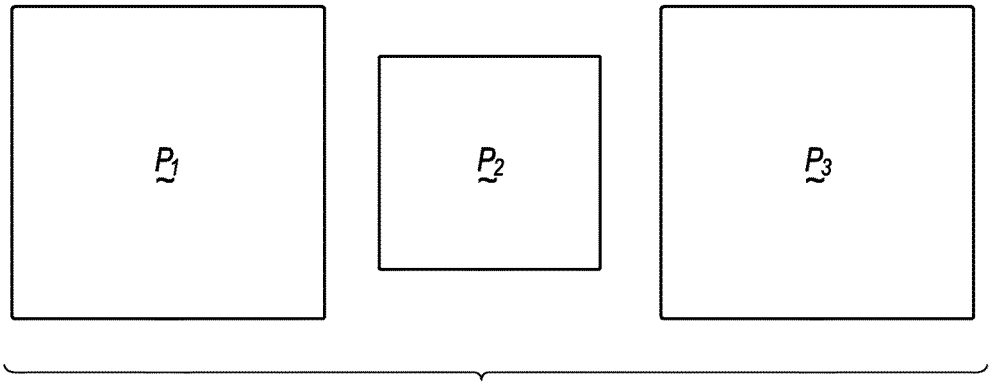
FIG. 7A is a top view of three filling materials used to fill an interior cavity of a seat cushion.
Figure 7B:
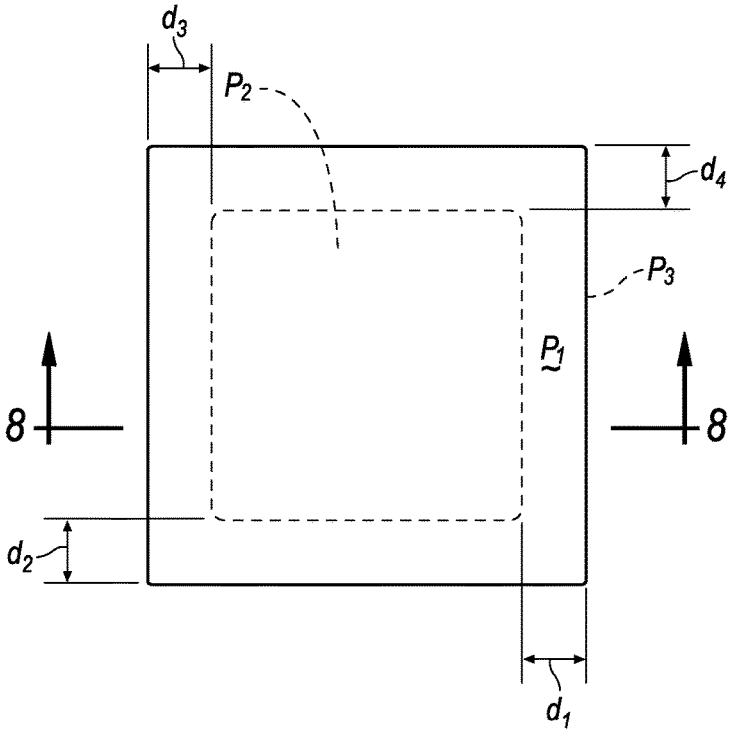
FIG. 7B is a top view of a configuration of the filling materials of FIG. 7A stacked on top of each other to fill the interior cavity of the seat cushion.
Figure 8:
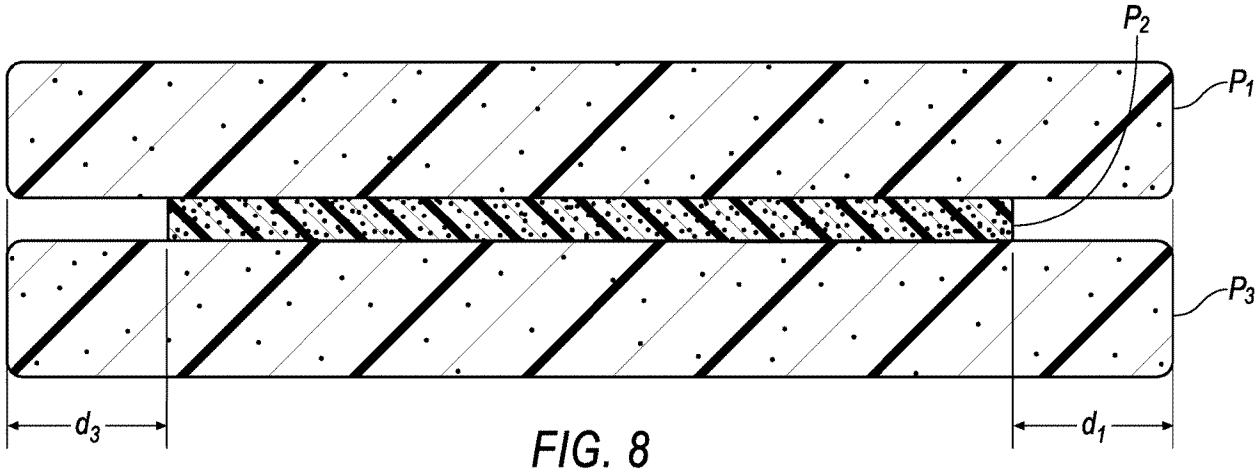
FIG. 8 is a cross-sectional view of the configuration of the filling materials of FIG. 7B stacked on top of each other to fill the interior cavity of the seat cushion.
Figure 9:
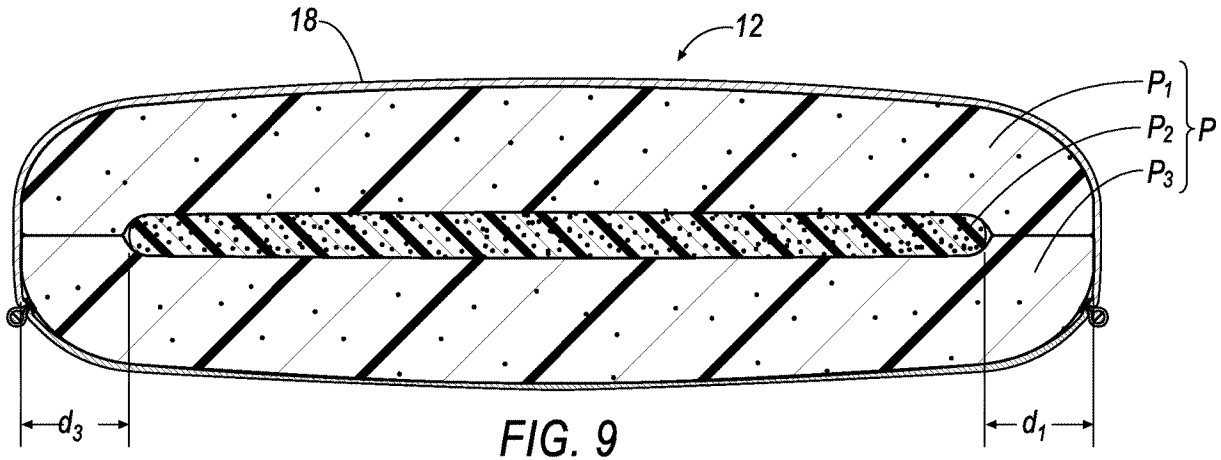
FIG. 9 is a cross-sectional view of the configuration of the filling materials of FIG. 8 with a cushion shell having upper, bottom and one or more side surfaces defining the interior cavity of the seat cushion and enclosing the configuration of the filling materials of FIGS. 8 and 7B.

Referring to FIGS. 7-9, in some implementations, the cushion fill 26 within the cavity 24 (FIGS. 1-4) includes one or more materials that may be loose fill or sheet formed fill materials. The cushion fill may include one or more portions P1, P2, P3 sized and arranged to achieve a shape that forms the natural convex curvature profile in the shell upper surface 18 (FIG. 9) when the cushion shell 12 encloses the one or more portions of the cushion fill. FIG. 7A is a top-view of the one or more fill portions P1, P2, P3 of the cushion fill 26. In some examples, the one or more fill portions $P_1$, $P_2$, $P_3$ may be layered in two or more levels to form a stack of fill portions $P_1$, $P_2$, $P_3$. For example, $P_1$ may include a top layer portion; $P_3$ may include a bottom layer portion when the cushion 10 is in the normal use orientation; and $P_2$ may include a middle layer portion sandwiched between portions $P_1$ and $P_3$. FIG. 7B is a top-view of the one or more fill portions $P_1$, $P_2$, $P_3$ of FIG. 7A layered to form the stack of fill portions $P_1$, $P_2$, $P_3$. FIG. 8 is a cross-sectional side-view of the one or more fill portions $P_1$, $P_2$, $P_3$ of FIG. 7A layered to form the stack of fill portions $P_1$, $P_2$, $P_3$. FIG. 9 is a cross-sectional side-view of the formed stack of fill portions $P_1$, $P_2$, $P_3$ enclosed by the shell upper, side and bottom portions 18, 20, 22, respectively, of the cushion shell 12.

In some implementations, the middle portion $P_2$ may be sized smaller than the portions $P_3$ or $P_1$ along at least one dimension. For instance, the smaller-sized middle portion $P_2$ may allow at least a distance $d_1$ between at least one edge of portion $P_2$ and at least one edge of portions $P_1$ or $P_3$, as shown in FIGS. 7-9. In other implementations, as shown in FIG. 7B, the middle portion $P_2$ may be sized relative to portions $P_1$ and $P_3$ such that two or more edges of $P_2$ fall short of either or both of edges of $P_3$ and $P_1$ leaving one or more distances $d_2$, $d_3$ or $d_4$. In some implementations, the top portion $P_1$ and the bottom portion $P_3$ may be sized the same. In other implementations, the top portion $P_1$ and the bottom portion $P_3$ may be sized differently.

In some implementations, referring to FIGS. 8 and 9, the fill portions $P_1$, $P_2$, $P_3$ may possess different densities. For instance, when the middle portion $P_2$ is sandwiched between the portions $P_1$ and $P_3$ (FIG. 8), the density of $P_2$ may be greater than that of $P_1$ or $P_3$. Once the cushion shell 12 is provided to enclose the fill portions $P_1$, $P_2$, $P_3$ (FIG. 9), the natural convex curvature profile or crown is formed in the shell upper surface 18. The natural convex curvature profile in the upper surface 18 forms the natural roll or radius around the corners between the upper and side surfaces 18, 20, respectively. In some implementations, the sizing of the fill portions $P_1$, $P_2$, $P_3$ is selected to achieve a desired natural convex curvature profile including a desired natural roll or radius around the corners. This convex curvature profile in the shell upper surface 18 may advantageously promote water shedding from the upper surface 18 toward the edges of the cushion shell 12. Increasing the density of portion $P_2$ to be greater than the densities of $P_3$ or $P_1$ reduces a tendency for a center region (e.g., seating region) of the cushion 10 to compact and sag, i.e., undesirably assume a concave curvature profile as the cushion 10 wears, to thereby promote water shedding throughout the useful life of the cushion 10.

While the examples provided include three fill portions $P_1$, $P_2$, $P_3$ sized and arranged to achieve the shape that forms the natural convex curvature profile in the shell upper surface 18, implementations are envisioned wherein two or less fill portions can be utilized to form the natural convex curvature profile. For example, fill 26 (FIGS. 1-4) may include only one portion $P_1$ having one or more sections removed at the center to achieve one or more gaps at distances $d_1$ and/or $d_2$ to resemble a similar configuration (e.g., the shape) as that formed by the stack illustrated in FIG. 8. In another example, the fill 26 may include two portions $P_1$ and $P_2$ stacked, wherein the top portion $P_1$, or the bottom portion layer $P_2$, has one or more sections removed at the center to achieve the one or more gaps at distances $d_1$ and/or $d_2$.

In some implementations, each of the fill portions $P_1$, $P_2$, $P_3$ include the same fill material. In other implementations, each of the fill portions $P_1$, $P_2$, $P_3$ include a different fill material than the other fill portions $P_1$, $P_2$, $P_3$. As shown in FIG. 9, welting may be eliminated from the seamless cushion upper surface 18 to prevent water or moisture that may be present on the outside of the upper surface 18 from entering the fill residing cavity 24 through the upper surface 18.

A number of implementations have been described. Nevertheless, it will be understood that various modifications may be made without departing from the spirit and scope of the disclosure. Accordingly, other implementations are within the scope of the following claims.

What is claimed is:

1. A cushion, comprising:

a cushion shell formed to define a fill receiving cavity, the cushion shell including:

a shell upper surface that is generally oriented horizontally when the shell is in a normal use orientation, the shell upper surface does not contain any seams and is fabricated from at least one water impervious material, at least one shell side surface that is generally oriented vertically when the shell is in the normal use orientation, the at least one shell side surface is fabricated from the at least one water impervious material, and a shell bottom surface that is generally oriented horizontally when the shell is in the normal use orientation, the shell bottom surface is fabricated from a water pervious material and is joined to the at least one shell side surface along a bottom edge seam; and a cushion fill that resides within the fill receiving cavity, wherein the at least one shell side surface includes one or more portions joined together along a non-exposed side seam including stitching that is not directly exposed to the surfaces of the shell that are exterior to the fill receiving cavity.

2. The cushion of claim 1, wherein the at least one shell side surface does not contain any seams.

3. The cushion of claim 1, wherein the bottom edge seam includes non-exposed stitching that is not directly exposed to the surfaces of the shell that are exterior to the fill receiving cavity.

4. The cushion of claim 1, wherein the cushion fill is fabricated from a non-water absorbing material that permits water to easily pass through the cushion fill.

5. The cushion of claim 4, wherein the non-water absorbing material of the cushion fill comprises polyester fiber.

6. The cushion of claim 4, wherein the non-water absorbing material of the cushion fill is manufactured by an Air Laid process.

7. The cushion of claim 1, wherein the cushion shell further includes welting provided along the shell bottom edge seam, the welting including a welting cover material that defines a space wherein a welting core material resides.

8. The cushion of claim 7, wherein the welting cover material is fabricated from the at least one water impervious material and is sewn to the bottom edge seam using non-exposed stitching that is not directly exposed to the surfaces of the shell that are exterior to the fill receiving cavity.

9. A cushion including a cushion fill enclosed by a cushion shell, comprising:

the cushion shell comprising a shell upper surface containing no seams and at least one shell side surface, the shell upper surface and the at least one shell side surface each fabricated from a water impervious material; and the cushion fill fabricated from a non-water absorbing material and having a shape that forms a natural convex curvature profile in the shell upper surface when enclosed by the cushion fill, wherein the at least one side surface includes one or more portions joined together along a non-exposed side seam including stitching that is not visible to a viewer from outside of the cushion shell.

10. The cushion of claim 9, wherein the cushion fill having the shape comprises three fill portions layered to form a stack, the three fill portions comprising:

a top portion when the cushion is in the normal use orientation;

a bottom portion; and a middle portion sandwiched between the top and bottom portions.

11. The cushion of claim 10, wherein the middle portion comprises a smaller size than each of the top and bottom portions along at least one dimension.

12. The cushion of claim 11, wherein the middle portion is arranged between the top and bottom portions such that at least two edges of the middle portion are less than corresponding edges of the top and bottom portions.

13. The cushion of claim 10, wherein the density of the middle portion is greater than densities of the top and bottom portions.

14. The cushion of claim 9, wherein the natural convex curvature profile formed in the shell upper surface forms a natural roll around corners between the shell upper surface and the at least one shell side surface.

15. The cushion of claim 9, wherein the cushion fill having the shape comprises at least two fill portions layered to form a stack.

16. The cushion of claim 9, wherein the at least one shell side surface does not contain any seams.

17. The cushion of claim 9, wherein the cushion shell further comprises:

a shell bottom surface fabricated from a water pervious material, the shell bottom surface joined to the side surface along a non-exposed bottom edge seam.

18. The cushion of claim 17, wherein the cushion shell further comprises:

welting including a welting cover material that defines a space wherein a welting core material resides, the welting cover material fabricated from the water impervious material and sewn to the non-exposed bottom edge seam using non-exposed stitching.

19. A cushion including a cushion fill enclosed by a cushion shell, comprising:

the cushion shell comprising a shell upper surface containing no seams and at least one shell side surface, the shell upper surface and the at least one shell side surface each fabricated from a water impervious material; and the cushion fill fabricated from a non-water absorbing material and having a shape that forms a natural convex curvature profile in the shell upper surface when enclosed by the cushion fill, wherein the cushion shell further includes a shell bottom surface fabricated from a water pervious material, the shell bottom surface joined to the side surface along a non-exposed bottom edge seam.

* * * * *